US005792977A

United States Patent [19]

Chawla

[11] Patent Number: 5,792,977

[45] Date of Patent: Aug. 11, 1998

[54] HIGH PERFORMANCE COMPOSITE SHAPED CHARGE

[75] Inventor: Manmohan S. Chawla, Adelphi, Md.

[73] Assignee: Western Atlas International, Inc., Houston, Tex.

[21] Appl. No.: 874,759

[22] Filed: Jun. 13, 1997

[51] Int. Cl.[6] ..... F42B 1/02

[52] U.S. Cl. ..... 102/307; 102/309; 102/476

[58] Field of Search ..... 102/307, 309, 102/476

[56] References Cited

U.S. PATENT DOCUMENTS

| | | | |
|---|---|---|---|
| 3,726,224 | 4/1973 | Pugh et al. | 102/56 |
| 3,976,010 | 8/1976 | Zernow | 102/56 SC |
| 4,498,367 | 2/1985 | Skolnick et al. | 86/1 R |
| 4,860,655 | 8/1989 | Chawla | 102/306 |
| 4,862,804 | 9/1989 | Chawla et al. | 102/309 |
| 4,922,825 | 5/1990 | Aubry et al. | 102/476 |
| 5,175,391 | 12/1992 | Walters et al. | 102/307 |
| 5,259,317 | 11/1993 | Lips | 102/307 |
| 5,322,020 | 6/1994 | Bernard et al. | 102/476 |
| 5,479,860 | 1/1996 | Ellis | 102/313 |
| 5,509,357 | 4/1996 | Lawther | 102/476 X |
| 5,559,304 | 9/1996 | Schweiger et al. | 102/501 |
| 5,565,644 | 10/1996 | Chawla | 102/307 |
| 5,619,008 | 4/1997 | Chawla et al. | 102/310 |

*Primary Examiner*—Peter A. Nelson
*Attorney, Agent, or Firm*—Alan J. Atkinson

[57] ABSTRACT

A shaped charge for efficiently transferring energy from an explosive material to generate a deep penetrating jet. The shaped charge liner is formed with a hemispherical first section combined with an elongated second section. The liner second section can be formed as a truncated cone, trumpet, or other shape. The hemispherical first section collapses to generate a high velocity jet portion, and the second section collapses to generate an elongated, deep penetrating jet portion which follows the higher velocity jet portion.

16 Claims, 1 Drawing Sheet

HIGH PERFORMANCE COMPOSITE SHAPED CHARGE

BACKGROUND OF THE INVENTION

The present invention relates to shaped charges for generating material perforating jets. More particularly, the present invention relates to a high performance composite shaped charge formed by the unique combination of a hemispherical section and a secondary, open ended section for generating a deep penetration jet.

Shaped charges are used in the oil and gas industry and in other fields to pierce metal, concrete and other solid materials. In an oil and gas well, a metallic casing is cemented to the borehole wall to maintain borehole integrity and to facilitate the placement of tubing and well tools within the borehole. Shaped charges are incorporated in a hollow carrier gun or a strip lowered into the casing. The shaped charges are activated to produce material penetrating jets which pierce the well casing and the geologic formation at the hydrocarbon producing zone. The hydrocarbons flow through such casing perforations casing and are transported to the well surface.

Conventional shaped charges are constructed with a charge case, a symmetrical hollowed conical liner within the case, and a high explosive material positioned between the liner and case. A detonator is activated to initiate the explosive material and to generate a detonation wave. This wave collapses the symmetrical liner toward a longitudinal axis of the liner hollow and a high velocity metallic jet and a relatively slow moving slug are simultaneously formed. The inner portion of each liner element contributes toward jet formation, and the outer portion of each liner element agglomerates to form the slug. The high velocity jet pierces the well casing and geologic formation.

The jet properties and material penetrating capabilities depend on factors such as the configuration of the shaped charge components, released energy, liner mass and composition, and resulting jet velocity. The liner shape can significantly influence jet performance. Conical liners typically generate a small entry hole and high penetration depth. Curved liners typically generate a large entry hole and low penetration depth. In the relatively narrow well casing interior, the effective shaped charge configuration is limited by the casing diameter and shaped charge orientation.

Various techniques have been proposed to improve shaped charge efficiency. U.S. Pat. No. 3,100,445 to Poulter (1963) taught an elliptical liner. U.S. Pat. No. 3,027,838 to Meddick (1962) used a conventional cone shaped liner. In U.S. Pat. No. 3,224,368 to House (1965), an outer aluminum liner was placed adjacent to the charge explosive material, and an inner copper liner was separated from the outer liner by a gap. The inner copper liner was shaped as a cone, a trumpet, or an integral combination of two cones having different slopes. In U.S. Pat. No. 4,862,804 to Chawla et al. (1989), an implosion shaped charge device used a hemispherical liner, activatable with different techniques, for radial convergence to a small volume. The pressure and density within such small volume achieved high values, resulting in a high velocity jet propagation in the direction of maximum pressure gradient. Other jet altering techniques position multiple liner elements within a shaped charge. In EP 437,992 A1 by Durand (1991), a munitions explosive charge for an armour-piercing weapon showed multiple metallic layers separated by an air gap. In U.S. Pat. No. 4,982,665 to Sewell et al. (1991), an air gap separated the liner from the explosive material.

The continuing search for improved jet performance in different materials and applications presents a need for shaped charge innovations. In particular, a need exists for an improved shaped charge that increases perforating jet performance without increasing the amount of high explosive material.

SUMMARY OF THE INVENTION

The present invention discloses a method for optimizing material penetration by a shaped charge penetrating jet. A shaped charge activatable by a detonator comprises a housing having a recess defined by the inner housing surface. The recess has an open end and a closed end, and a high explosive within said recess is activatable by the detonator to generate a detonation wave. A liner is positioned proximate to the high explosive. The liner has a first section substantially formed as a hemisphere and has a proximate second section extending away from said first section to form an open end facing said recess open end. The liner is collapsible by said detonation wave to form a deep penetration jet.

DESCRIPTION OF THE PREFERRED EMBODIMENTS

Figure 1:
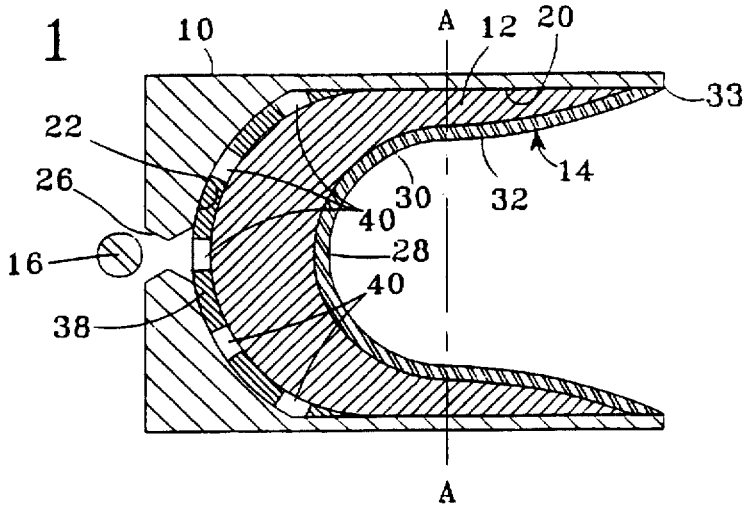
FIG. 1 illustrates a sectional view of a shaped charge having a liner formed with two contiguous sections.

The present invention provides an improved shaped charge that substantially improves the jet efficiency and penetration depth. FIG. 1 illustrates shaped charge having case 10, high explosive 12 and liner 14. The shaped charge has an axis as shown, and liner 14 is typically symmetric about such axis. Detonator 16 initiates a detonation wave in high explosive 12 which travels substantially parallel to the shaped charge axis. The detonation wave collapses liner 14, beginning at apex 28 of liner 14, and creates a metallic jet traveling at high velocities up to 10,000 meters per second. The detonation wave also creates a trailing slug traveling at a significantly lower velocity. Each element along liner 14 generates a high velocity jet component and a slower moving slug component, and the high velocity jet components cooperate to perforate a selected target.

Shaped charge case 10 has interior wall 20 which defines a recess within case 10. Case 10 includes closed end 22 and open end 24. Closed end 22 can be cast, milled or otherwise formed into a hemispherical shape similar to the shape of liner 14. Aperture 26 extends through closed end 22 to permit initiation of high explosive 12 with detonator 16. As illustrated in FIG. 1, the profile of aperture 26 comprises a precision initiation hole shaped as an hourglass to concentrate the detonation wave initiated by detonator 16. In this fashion, the diameter of aperture 26 focuses the initiation to a small area commensurate with the critical diameter of the booster explosive in detonator 16. The wider opening facing high explosive material 12 ensures smooth wave propagation.

As known in the art, liners for shaped charges can comprise different materials. Liner materials include copper, aluminum, depleted uranium, tungsten, tantalum and other materials. A charge case is not essential to the performance of shaped charges, as a shaped charge can be constructed from the simple combination of a hollowed high explosive cavity and a liner forming a hollow cavity.

Liner 14 is illustrated as a continuous surface having apex 28. Liner 14 is substantially formed with at least two distinct sections. Liner first section 30 is hemispherical in shape and is bounded by apex 28 on one end and equator line through section A—A on the other end. Liner second section 32 is bounded by equator line through section A—A and by open end 33. First section 30 is preferably subcalibered so that the diameter of first section 30 is smaller than the diameter of case 10. This construction produces a concentrated, high velocity jet. In a preferred embodiment of the invention as shown, second section 32 is continuously blended with first section 30 to provide additional liner material suitable for jet formation. Following initiation of high explosive material 12, first section 30 collapses into a perforating jet and the length of such jet is extended with the collapsing material from second section 32. The resulting jet comprises an extremely long perforating jet having the initial perforating power from first section 30 combined with the jet length and penetration depth capability of second section 32.

Figure 2:
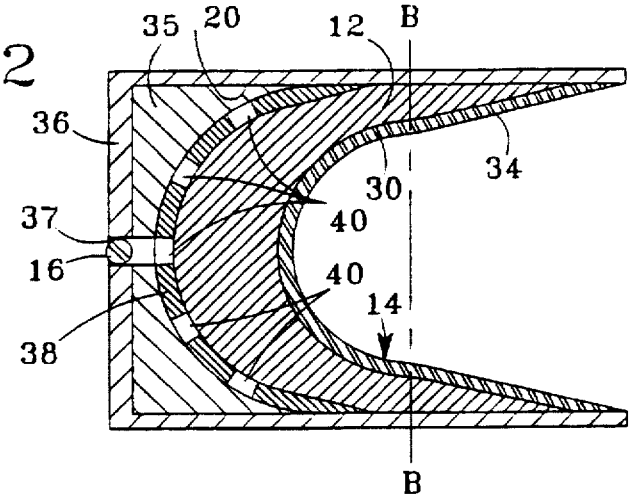
FIG. 2 illustrates a sectional view of a truncated, conical shaped liner second section.

The second section can be formed as a truncated trumpet, cone or other shape. FIG. 2 illustrates a liner configuration wherein second section 34 comprises a truncated cone bounded along Section B—B. The liner material mass within second sections 32 or 34 can be formed to be less than, equal to, or greater than the mass of first section 30. Such liner mass can be determined from the liner thickness and from the inner surface area of the liner section 32 or 34. In FIG. 2, insert 35 is inserted within charge case 36 to form a hemispherical end within the cylindrical charge case 36 as shown in FIG. 2. Although charge case 36 can be formed with a cylindrical end as shown in FIG. 1, insert 35 can be formed with different materials and can lower the cost of constructing charge case 36. Insert 35 and charge case 36 have cylindrical aperture 37 which communicates with detonator 16.

In the inventive embodiment shown in FIG. 1, the mass of second section 32 is greater than the mass of first section 30. Second section 32 will collapse to form an elongated portion of the high velocity jet which trails behind the jet portion formed by first section 30. In the inventive embodiment shown in FIG. 2, second section 34 will collapse to form an elongated jet portion thinner than the jet portion formed by first section 30.

Second section 32 or second section 34 can be in contact with first section 30, can be separated from first section 32, or can be positioned so that a portion of second section 32 or second section 34 overlaps a portion of first section 30. Alternatively, the first and second sections can be continuous and formed with the same sheet of metal or other material. The precise orientation and placement of second section 32 or second section 34 relative to first section 30 will determine the size, orientation and other properties of the produced material penetrating jet.

FIGS. 1 and 2 illustrate one technique for collapsing liner 14. A hydra 38 is positioned within case 10 in an orientation substantially equidistant from first section 30. Although not essential to the successful operation of the invention, the performance of liner collapse can be enhanced by using hydra 38 or other forms of multi-point or simultaneously initiating mechanism. Hydra 38 can incorporate multiple micro-detonators 40. Micro-detonators 40 can be operated in cooperation with buffer plates and other delays, or can be adjusted by the channel lengths or differing speed explosives in various channels. Hydra 38 is substantially formed with the same radius as first section 30, and micro-detonators 40 provide for the multiple point initiation of high explosive material 12. Hydra 38 permits a virtually simultaneous generation of the shock wave in a manner that the shock wave simultaneously contacts liner first section 30. This procedure simultaneously collapses first section 30 toward a point along the axis which produces an efficient, high velocity perforating jet.

Other techniques can be utilized to produce a shock wave configured to simultaneously contact hemispherical first section 30. A shock wave shaping lens can be positioned within high explosive material 12, shock wave barriers can be configured to control shock wave propagation, or laser detonation devices can selectively initiate high explosive material 12. Alternatively, light sensitive material can provide surface initiation of high explosive 12. Although point initiation can collapse liner 14, multi-point or surface initiation types will more efficiently transfer energy from high explosive material 12 to collapse liner 14.

Figure 3:
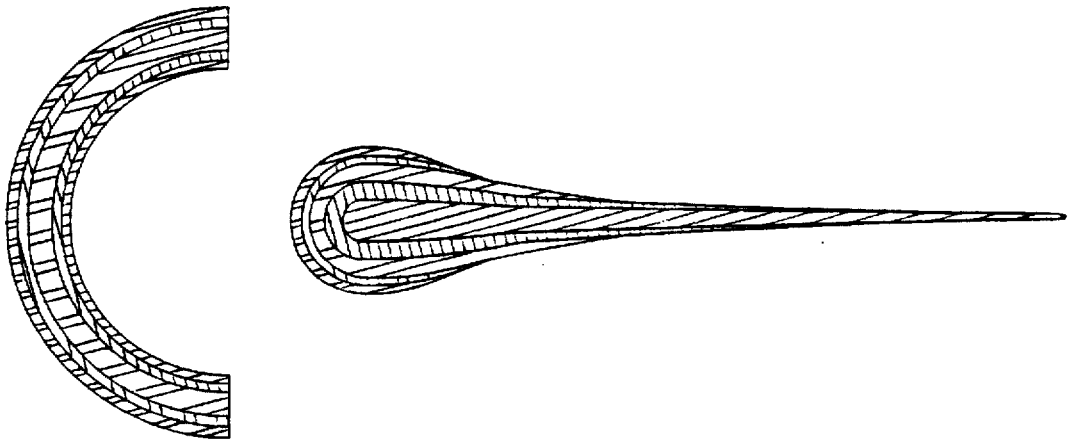
FIG. 3 illustrates a representative view of jet formation from the hemispherical section of the liner illustrated in FIGS. 1 and 2.

The composite perforating jet formed by the invention is particularly useful in producing a material or target perforating jet having a high velocity tip followed by slower moving jet and a minimal slug. The two liner portions produce jets by different mechanisms. In a preferred embodiment of the invention, the first portion of the liner is imploded simultaneously so that the liner material squeezes to the hemisphere center as shown in FIG. 3. Such Figure shows a liner in different layers to illustrate the relative location of elements before and after collapse. The liner can be formed with a single material or a combination of layered materials as illustrated. The thickness of different liner layers in FIG. 3 are exaggerated to more clearly show the subsequent location of each layer within the resulting jet. As illustrated in FIG. 3, the innermost layer of the liner forms the leading portion of the jet. Because of the enormous difference in the pressure at the center and in the space directly ahead of the imploded hemisphere, the material squirts out in the forward direction with enormous speed. The jet speed will be considerably smaller if the conventional point initiation rather than simultaneous surface initiation scheme is employed.

As a consequence of the implosion, the hemispherical liner compresses to a small odd shaped ball, inverts itself inside out and moves rapidly in the forward direction. As shown in FIG. 3, the innermost layer of the liner becomes the outermost layer in the comet shaped jet and stretches from its tip to tail, and the innermost layer of the jet is formed from the material on the outermost portion of the liner previously in contact with the explosive. For the simultaneously imploded liner, there is very little slug. This layer by layer jet formation is the hallmark of the hemispherical liners and can be used in constructing novel composite jets where the inner layer is made of one material and the outer layer of another material. The innermost layer of the first portion of the hemispherical liner, for example, can be made of high density material (tungsten, depleted uranium or gold) for achieving superior penetration, the outermost layer can be made of reactive material such as aluminum or Teflon and aluminum, which can be injected inside a cavity made by the perforating portion of the jet.

The second liner section collapses in a conventional fashion where each liner element contributes to both the jet and the slug. The collapse of the second liner section lacks the layer by layer inversion of the liner material.

This composite jet configuration provided by the invention generates large penetration depths for a given quantity of high explosive material and liner mass. Performance gain over conventional shaped charges is accomplished by placing the mass of second section 32 in a location to combine with the jet produced by first section 30. Although second section 32 is illustrated as being positioned adjacent to first section 30 to produce a continuous jet, second section 32 could be separated from first section 30 to segregate the jet into two discrete jet portions. The second liner section can be curvilinearly shaped, and more than two liner sections can be combined or proximately placed to accomplish the inventive function. The second liner section can have the same density as the first liner section, or can be formed with a material having a greater or lesser density than that of the first liner section. As described herein, references to a liner section section refer to all forms and configurations of a second section, and the mass of second section can be greater, equal to or less than the mass of the first section.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A shaped charge activatable by a detonator to generate a deep penetration jet, comprising:

a housing;

a recess defined by an inner housing surface within said housing, wherein said recess has an open end and a closed end;

a high explosive within said recess which is activatable by the detonator to generate a detonation wave; and a liner having a first section substantially formed as a hemisphere collapsible by said detonation wave to form a first penetration jet segment moving in a selected direction, wherein said liner further has a proximate second section between said first section and said recess open end which is collapsible by said detonation wave to form a second penetration jet segment moving in said selected direction for cooperating with said first penetration jet segment to form the deep penetration jet.

2. A shaped charge as recited in claim 1, wherein said liner second section is attached to said liner first section.

3. A shaped charge as recited in claim 1, wherein said second liner section is attached to said liner first section substantially near the equator of said liner first section.

4. A shaped charge as recited in claim 1, wherein said liner second section is shaped as a truncated cone.

5. A shaped charge as recited in claim 1, wherein said liner second section is shaped as a truncated trumpet.

6. A shaped charge as recited in claim 1, wherein said liner second section has a shape providing a greater surface area facing said recess open end than a truncated cone shaped liner second section located in the same position between said liner first section and said recess open end, for maximizing the mass of said liner second section between said liner first section and said recess open end.

7. A shaped charge as recited in claim 1, wherein said the detonator causes the detonation wave to simultaneously impact said first liner section.

8. A shaped charge as recited in claim 1, further comprising a liner third section between said liner second section and said recess open end.

9. A shaped charge as recited in claim 1, further comprising a multi-point initiating mechanism for detonating said high explosive.

10. A shaped charge for extending the length of a material penetrating jet, comprising:

a housing;

a recess defined by an inner housing surface within said housing, wherein said recess has an open end and a closed end;

a high explosive within said recess which is activatable by the detonator to generate a detonation wave;

a first liner section substantially formed as a hemisphere having an apex and having a second end between said apex and said recess open end, wherein said first liner section is collapsible by said detonation wave to form a first penetration jet segment moving in a selected direction; and a second liner section between said first liner section second end and said recess open end, wherein said second liner section comprises a different material than said first liner section and is collapsible by said detonation wave to form a second penetration jet segment moving in said selected direction for cooperating with said first penetration jet segment to form the deep penetration jet.

11. A shaped charge as recited in claim 10, wherein said first liner section is simultaneously collapsible with said second liner section, and wherein said first penetration jet segment leads said second penetration jet segment.

12. A shaped charge as recited in claim 10, wherein said second liner section is generally shaped as a truncated cone.

13. A shaped charge as recited in claim 10, wherein said second liner section is generally shaped as a truncated trumpet.

14. A shaped charge as recited in claim 10, wherein said second liner section is formed with a material having a different density than the material forming said first liner section.

15. A shaped charge as recited in claim 11, wherein said second end is formed with material having a different density than the material forming said first end.

16. A shaped charge as recited in claim 11, wherein said housing is substantially cylindrical, further comprising an insert within said housing recess for defining a hemispherical surface having a radius substantially equal to the radius of said liner first section.

* * * * *